US009388708B2

(12) United States Patent
Heidingsfelder et al.

(10) Patent No.: US 9,388,708 B2
(45) Date of Patent: Jul. 12, 2016

(54) TURBOCHARGER

(75) Inventors: Leif Heidingsfelder, Ramstein (DE); Thomas Ramb, Worms (DE)

(73) Assignee: BorgWarner Inc., Auburn Hills, MI (US)

( * ) Notice: Subject to any disclaimer, the term of this patent is extended or adjusted under 35 U.S.C. 154(b) by 906 days.

(21) Appl. No.: 13/696,812

(22) PCT Filed: May 18, 2011

(86) PCT No.: PCT/US2011/036907

§ 371 (c)(1),
(2), (4) Date: Nov. 8, 2012

(87) PCT Pub. No.: WO2011/146555

PCT Pub. Date: Nov. 24, 2011

(65) Prior Publication Data

US 2013/0051988 A1 Feb. 28, 2013

(30) Foreign Application Priority Data

May 19, 2010 (DE) ..... 10 2010 020 864

(51) Int. Cl.
*F02B 37/24* (2006.01)
*F01D 17/16* (2006.01)

(52) U.S. Cl.
CPC ..... *F01D 17/165* (2013.01); *F02B 37/24* (2013.01); *F05D 2220/40* (2013.01); *F05D 2250/71* (2013.01)

(58) Field of Classification Search
CPC ..... F02B 37/22; F02B 37/24; F01D 17/165
See application file for complete search history.

(56) References Cited

U.S. PATENT DOCUMENTS

| | | | | |
|---|---|---|---|---|
| 7,670,107 | B2 * | 3/2010 | Barthelet | F01D 17/165 29/889.2 |
| 2009/0092483 | A1 * | 4/2009 | Yasui | F01D 17/165 415/159 |
| 2010/0014961 | A1 * | 1/2010 | Boning | F01D 17/165 415/160 |
| 2010/0202874 | A1 * | 8/2010 | Hayashi | F01D 17/165 415/160 |

* cited by examiner

*Primary Examiner* — Dwayne J White
*Assistant Examiner* — Jeffrey A Brownson
(74) *Attorney, Agent, or Firm* — A. Michael Tucker; Stephan A. Pendorf; Patent Central LLC

(57) ABSTRACT

A turbocharger (1) with variable turbine geometry (VTG), having a blade bearing ring (6), which has a multiplicity of guide blades (7), and which has a stop (25) at least for adjusting the minimum throughflow through the nozzle cross sections formed by the guide blades (7), wherein the stop (25) has a fixing peg (32) on which a deformable, arched adjusting section (26) is arranged. Since the stop is formed as a deformable component which can be fixed in the guide grate, it is possible after the assembly of the guide grate to rework said stop in a simple manner in order to precisely set the required stop position, since said stop is not integrally connected to the guide grate.

19 Claims, 5 Drawing Sheets

TURBOCHARGER

Figure 1:
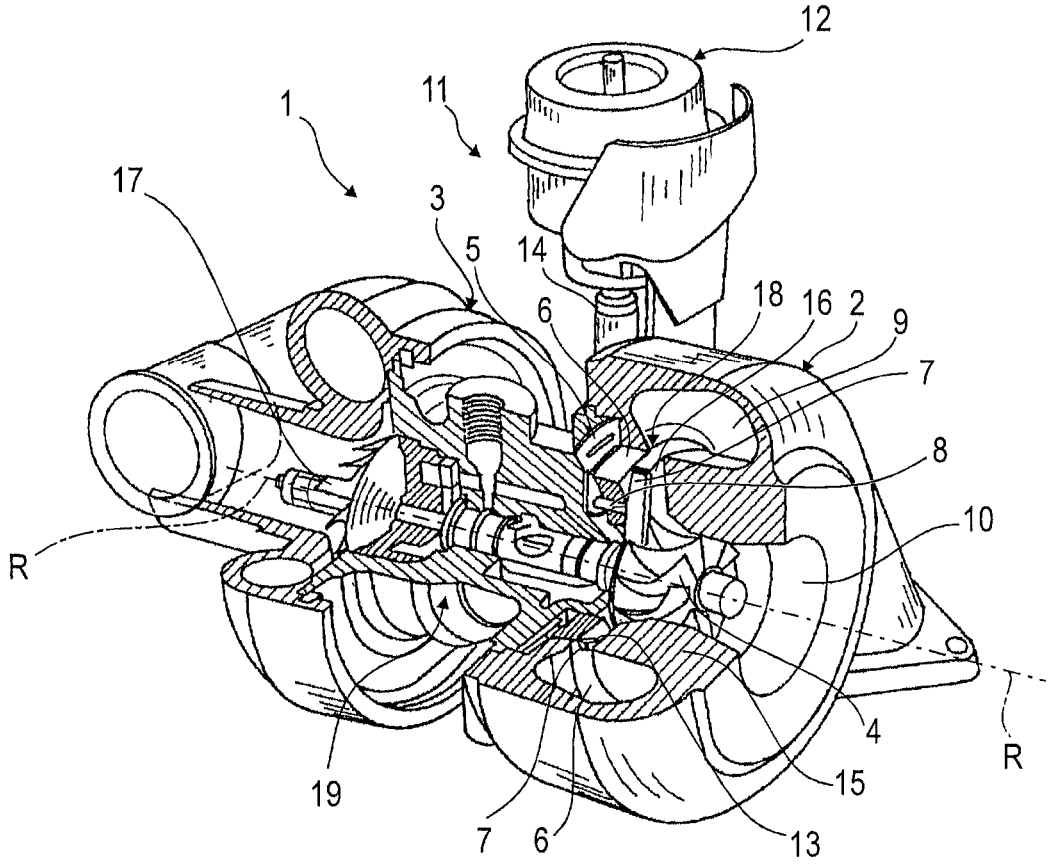

The invention relates to a turbocharger according to the preamble of claim 1.

A turbocharger of said type is known from EP 1 564 380 A1. To avoid weakening of the adjusting ring, said document proposes a stop which is integrally connected to the adjusting ring and which is composed of a web whose width can be varied or provided with an adjustable grub screw. Said design duly creates, to a certain extent, the possibility of an adjustable stop, but a stop formed in this way could scarcely be realized in practice because, firstly, the spatial conditions restrict the insertion of a grub screw, which moreover would require the provision of an internal thread in the single-piece stop part, and moreover it would be necessary to provide a locking facility for the grub screw in order to be able to fix the adjustment carried out. In reality, on account of the extremely restricted spatial conditions, this involves a high level of expenditure and is therefore not desirable.

As a result of the stop being integrally formed on the adjusting ring, however, in the known turbocharger it is possible only with relatively high expenditure, if at all, to rework the projection of the stop after the assembly of the guide grate, for example if it is intended or necessary for example to carry out a correction of the end positions of the guide grate. It is therefore an object of the present invention to provide a turbocharger of the type specified in the preamble of claim 1 which permits a simplification of the assembly of the guide grate or guide apparatus, wherein at least a simple and precise adjustment of the minimum throughflow should be possible by means of the guide apparatus alone.

Said object is achieved by means of the features of claim 1.

By virtue of the fact that the stop by means of which at least the minimum throughflow through the nozzle cross sections formed by the guide blades can be set is formed as a deformable component which can be fixed in the guide grate, it is possible after the assembly of the guide grate to rework said stop in a simple manner in order to precisely set the required stop position, since said stop is not integrally connected to the guide grate. Should it be necessary to readjust one of the two end positions of the guide grate, it is therefore possible either in a simple manner to select and assemble a stop part preformed for the desired end position, or the already-mounted stop part can be provided with the desired dimension by means of a plastic deformation process.

This firstly yields the advantage that the stop or the adjusting piece can be produced cost-effectively from sheet metal. The stop can then be mounted in the blade bearing ring and calked by means of a tool provided for the purpose, the change in the width of the adjusting piece or of the stop taking place as a result of flexing of the adjusting section. A precise deformation results here in the formation of a defined end stop for the adjusting ring and therefore a precise setting of the minimum throughput of the cartridge precisely according to customer requirements.

The advantage is also obtained that the stop can be of considerably simplified construction in relation to the prior art, which yields a reduction in costs for production and assembly.

The advantage of a reduced amount of machining in the blade bearing ring is also obtained.

In principle, it is possible for the stop to be fixed either to the blade bearing ring, which is fixed in the housing, or to the movable adjusting ring. Depending on this, the projection of the stop then interacts either with counterpart stop surfaces of the adjusting ring or with the fastening rings of the blade lever.

The advantage is also obtained that the entire guide apparatus can be completely preassembled as a cartridge and the minimum throughflow can be set before said cartridge is then inserted into the turbine housing.

The minimum throughflow is therefore set independently of the turbine housing and other components of the turbocharger, for example the bearing housing. Also, the connecting piece position between the bearing housing and turbine housing no longer has an influence on the minimum throughflow adjustment. Likewise, wear of the adjusting lever and of the point of engagement thereof on the adjusting ring has no effect on the minimum throughflow quantity.

The subclaims relate to advantageous refinements of the invention.

In a particularly preferred embodiment, the adjusting section of the stop has an arched central part, which may for example be of at least approximately semi-circular design. In this embodiment, radially projecting adjusting flanks are arranged on the two end regions of said arched central part, to which adjusting flanks calking forces can be applied for the purposes of adjustment. In this way, the dimension of the arching of the arched central part can be intentionally altered for the purpose of a change in the width of the adjusting section and, as a result of this, a change in the minimum throughflow, in particular according to customer requirements.

Here, it is preferably possible either for the stop to be fixed by being pressed already in the blade bearing ring or also to carry out the adjustment before the fixing in the blade bearing ring.

The arched central part may, in a first embodiment of the stop, be of single-layer design and be pre-formed in a preforming step and finished in a subsequent pressing step. Here, it is possible to provide a fit recess in a fixing peg of the stop, such that during assembly in the blade bearing ring, a secure seat in a fit bore, which may if appropriate be provided with a projection which can be inserted into the fit recess, can be ensured.

In an alternative embodiment, the central part is of two-layer and open design, for which purpose the stop may be folded from a sheet metal piece and subsequently formed, at the foot end, by a die into a round shape which can be pressed into the corresponding bore of the blade bearing ring. In this case, too, the two-layer arched central part has adjusting flanks to which calking forces can be applied in the installed state, such that in this embodiment too, the arching of the two-layer central part can be intentionally changed for the purpose of setting the minimum flow.

Finally, a further embodiment of the stop according to the invention is possible which again has a two-layer arched central part which, to prevent the two halves, which are preferably produced from sheet metal, from spreading apart during the pressing process, is additionally provided with two clamps. Said clamps adjoin the adjusting flanks of an arched part of the two-layer central part and engage, with end-side angled retaining fingers, behind the adjusting flanks of the other arched half of the central part, such that the abovementioned protection against spreading apart can be attained.

Claims 10 and 12 define, respectively, a guide grate and a stop in each case as an object that can be marketed separately.

Figure 3:
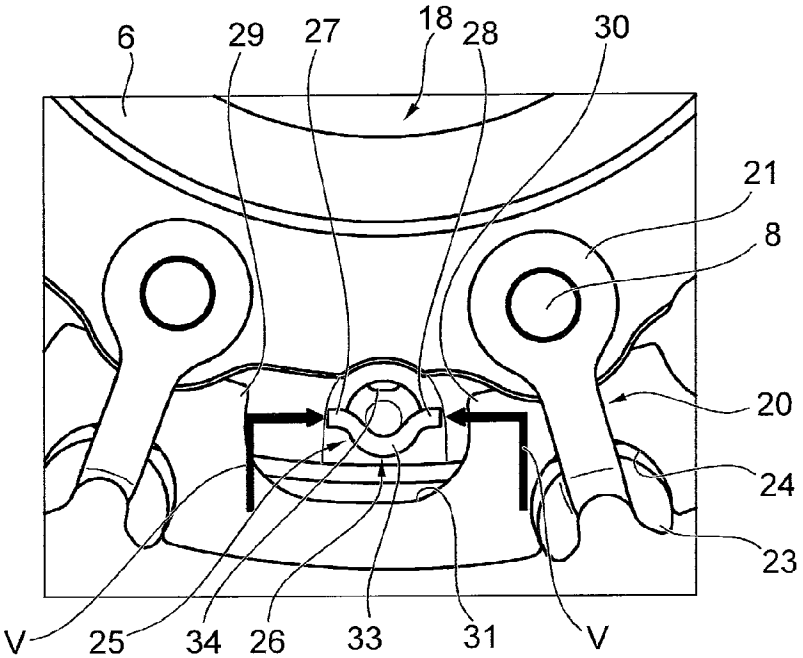
Figure 2:
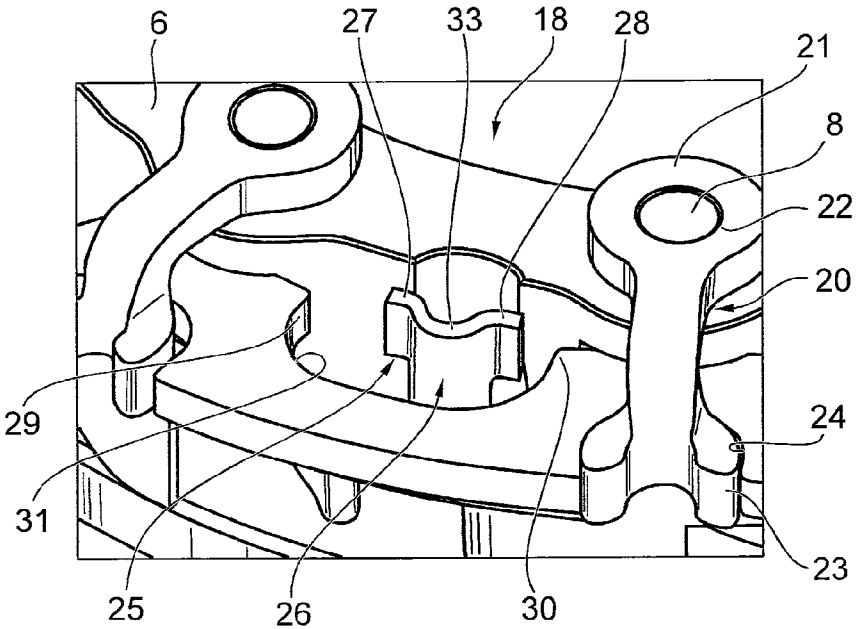
Figure 5:
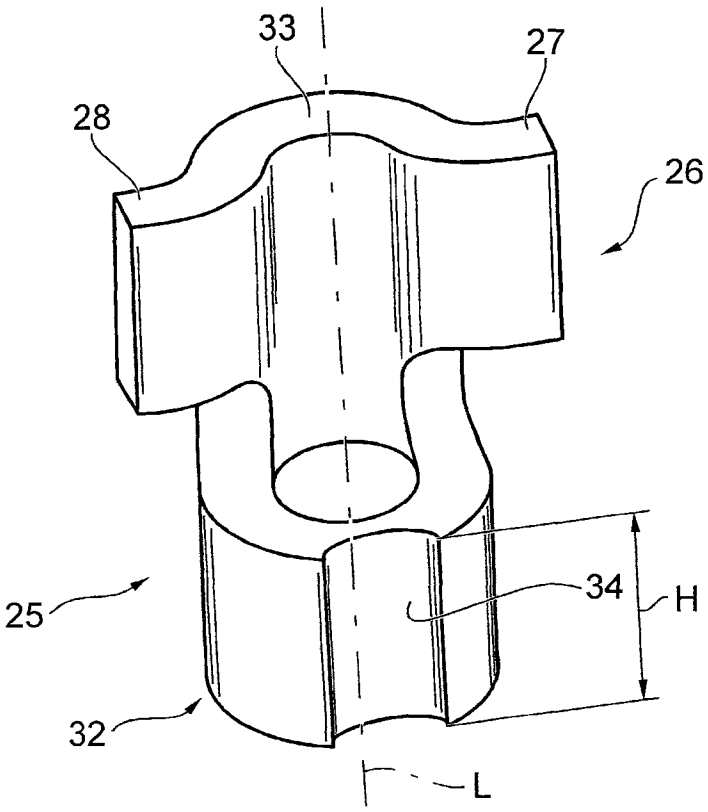
Figure 4:
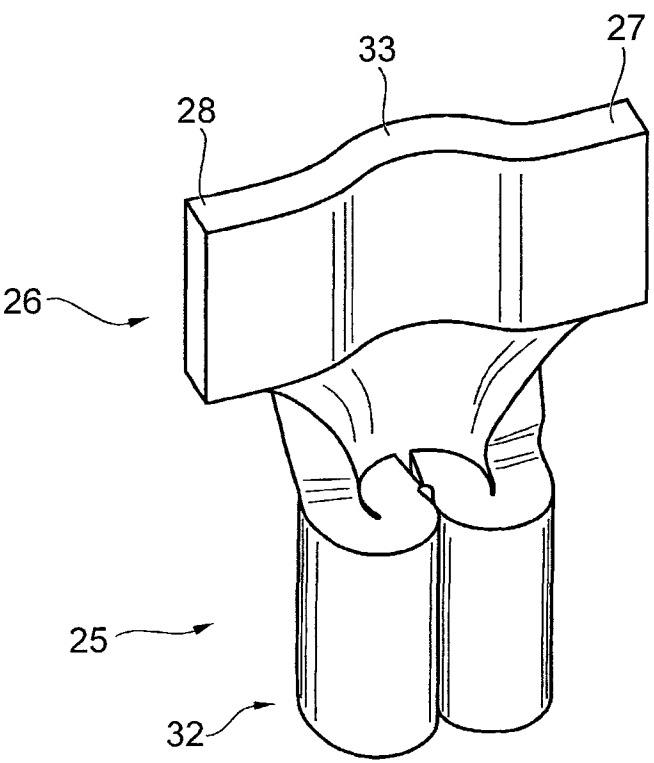
Figure 6:
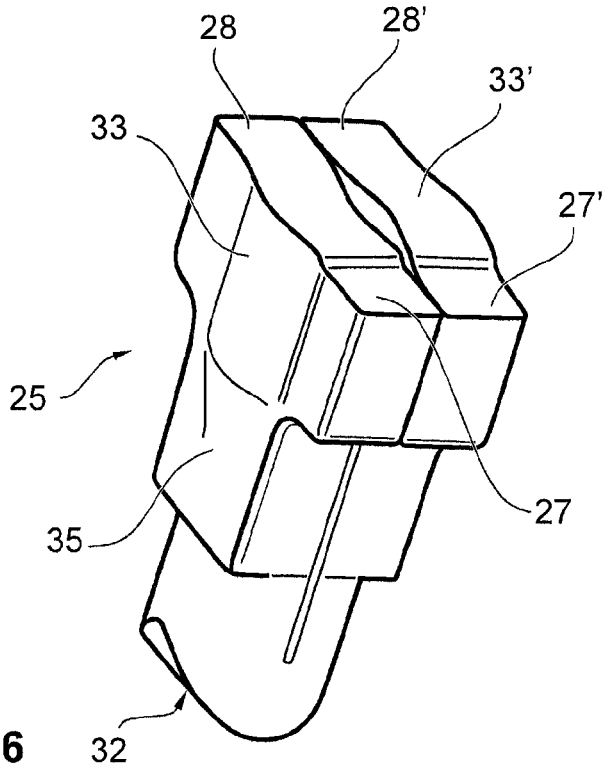
Figure 7:
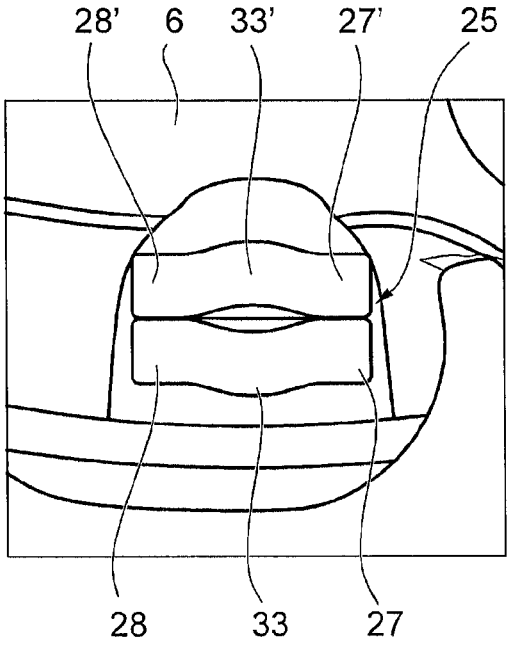
Figure 8:
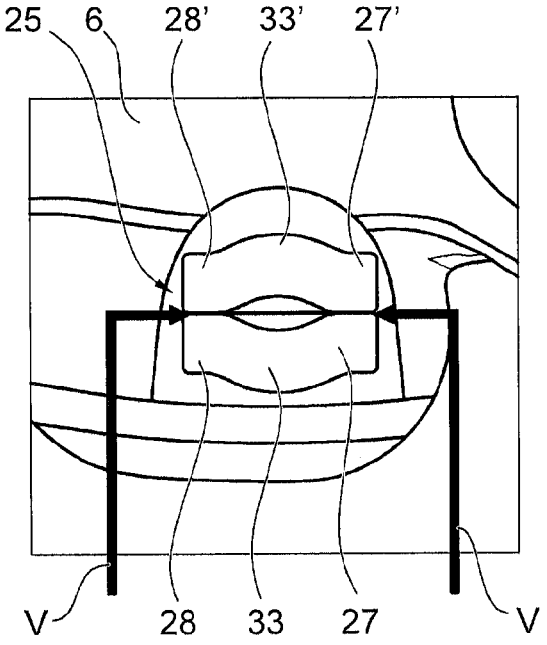
Figure 9:
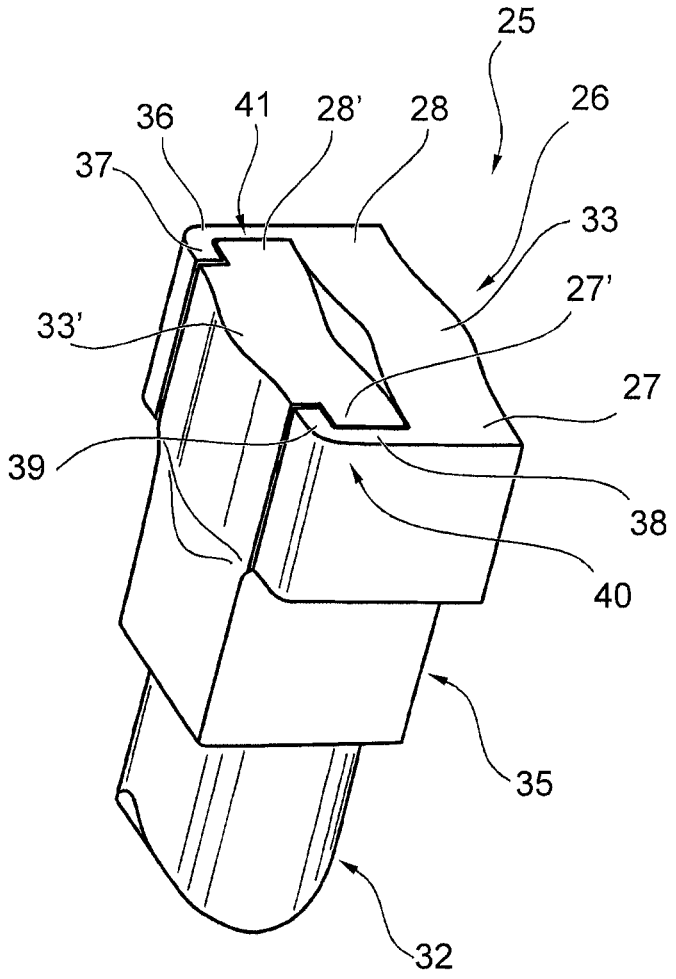

Further details, advantages and features of the invention will emerge from the following description of an exemplary embodiment on the basis of the drawing, in which:

FIG. 1 shows a sectional perspective illustration of the basic design of a turbocharger according to the invention, FIGS. 2 and 3 show partial views of the guide grate according to the invention, FIG. 4 shows a perspective illustration of a first embodiment of the stop according to the invention in the pre-deformed state of a sheet-metal piece, FIG. 5 shows an illustration, corresponding to FIG. 4, of the stop in the finished state, FIG. 6 shows a perspective illustration of a second embodiment of the stop according to the invention, FIG. 7 shows a plan view of a guide grate in which the embodiment of the stop according to FIG. 6 is mounted, FIG. 8 shows an illustration, corresponding to FIG. 7, of the guide grate with a stop deformed by calking forces after being installed into the guide grate, and FIG. 9 shows a perspective illustration of a third embodiment of the stop according to the invention.

FIG. 1 illustrates a turbocharger 1 according to the invention which has a turbine housing 2 and, connected thereto via a bearing housing 19, a compressor housing 3. The housings 2, 3 and 19 are arranged along an axis of rotation R. The turbine housing 2 is shown partially in section in order to show the arrangement of a blade bearing ring 6 as part of a radially outer guide grate 18 which has a multiplicity of guide blades 7, distributed over the circumference, with pivot axles or blade shafts 8. In this way, nozzle cross sections are formed which are larger or smaller depending on the position of the guide blades 7 and which supply exhaust gas of an engine, which is supplied via a supply duct 9 and discharged via a central connecting piece 10, to a greater or lesser extent to the turbine rotor 4 mounted in the centre on the axis of rotation R, in order by means of the turbine rotor 4 to drive a compressor rotor 17 seated on the same shaft.

To control the movement or the position of the guide blades 7, an actuating device 11 is provided. Said actuating device may be of any desired design, but a preferred embodiment has a control housing 12 which controls the control movement of a plunger element 14 fastened thereto in order to transmit the movement thereof to an adjusting ring 5 situated behind the blade bearing ring 6, so as to convert said movement into a slight rotational movement of said adjusting ring. Formed between the blade bearing ring 6 and an annular part 15 of the turbine housing 2 is a free space 13 for the guide blades 7. To be able to ensure said free space 13, the blade bearing ring 6 has integrally formed spacers 16. In the case of the example, three spacers 16 are arranged at angular intervals of in each case 120° about the circumference of the blade bearing ring 6. In principle, however, it is also possible for a greater or smaller number of such spacers 16 to be provided.

FIGS. 2 and 3 show partial views of an embodiment of the guide grate 18 according to the invention on a larger scale.

Illustrated representatively of all the blade levers of said guide grate 18 is a blade lever 20 which, at one end, has a fastening ring 21 with a recess 22 in which one end of the blade shaft 8 is fixed.

A lever head 23 of the blade lever 20 is arranged in an engagement recess 24 of the adjusting ring 5 and is therefore in engagement with the adjusting ring 5.

Furthermore, FIGS. 2 and 3 show the arrangement of a stop 25 in the guide grate 18.

As shown in detail in FIG. 3, the stop 25 has an arched adjusting section 26 with adjusting flanks 27, 28 which project radially at both sides and to which calking forces, indicated by the arrows V, can be applied using suitable tools if it is necessary, for example, to carry out an adjustment of the minimum throughflow.

FIG. 4 shows a first embodiment of the stop 25 according to the invention, said figure showing the stop 25 in a pre-formed state of a sheet-metal piece. The stop 25 accordingly has an adjusting section 26 with a central part 33 and with radially projecting adjusting flanks 27 and 28 and also a fixing peg 33 in the pre-formed state.

FIG. 5 shows the finished state, in which the abovementioned parts 26, 27, 28, 33 and 32 have assumed their final shape. It is clear from said illustration in particular that the central part 33 is of arched design, wherein in this case an almost semi-circular shape is attained.

Provided on the two end regions of said central part 33 are the stated adjusting flanks 27 and 28 which, viewed from the perspective of a longitudinal central line L, extend radially outward, such that the calking forces V, as can be seen from FIG. 3, can act on said adjusting flanks 27 and 28 for the purpose of changing the curvature of the central part 33.

FIG. 5 also shows that the fixing peg 32 is provided with a fit recess 34 which extends over the entire length L of the fixing peg 32. Said fit recess 34 may engage into a counterpart of the adjusting ring in the assembled state, wherein a secure interference fit may however also be attained without such a counterpart.

FIG. 6 shows a perspective illustration of a second embodiment of the stop 25 according to the invention. In said embodiment, the stop 25 is folded from a sheet-metal piece and is subsequently formed, at the foot end, by a die (not illustrated in FIG. 6) into a round shape of the fixing peg 32, which can be pressed into corresponding bores of the blade bearing ring 6.

As is also shown in FIG. 6, a two-layer embodiment is provided in this case which has two central parts 33 and 33' with associated adjusting flanks 27 and 28 or 27' and 28'.

As can be seen from the juxtaposition of FIGS. 6 to 8, said central parts 33 and 33' are situated with their adjusting flanks opposite one another, wherein FIG. 8 shows an assembled state in which the archings of the central parts 33 and 33' have been changed in relation to the state in FIG. 7 through the application of the calking forces V, so as to be able to carry out a retroactive adjustment of the minimum throughflow after the fixing of the stop 25 in the blade bearing ring 6. The change of the arching and therefore of the width of the adjusting piece 26 is also evident from the enlargement of the free space between the central parts 33 and 33'.

FIG. 9 finally shows a third embodiment of a stop 25 according to the invention, which corresponds in terms of its basic design to that of FIG. 6. In this respect, reference can be made to the entirety of the above description of the second embodiment.

The third embodiment according to FIG. 9 is characterized by the provision of two clamps 40 and 41, in the case of the example on the central part 33 or on the adjusting flanks 27 and 28.

For this purpose, the clamps 40 and 41 have in each case one elongation web 38 and 36. Here, the elongation web 36 adjoins the adjusting flank 27 at least substantially at right angles, and at its free end has an angled or cranked retaining finger 39. Correspondingly, the clamp 41 has an elongation web 36 which likewise extends substantially at right angles from the adjusting flank 28 in the direction of the second central part 33. The elongation web 36 is also provided, at its free end, with an angled or cranked retaining finger 37.

As shown in FIG. 9, the elongation webs 36 and 38 engage with their retaining fingers 37 and 39 around the adjusting flanks 28' and 27', such that in this embodiment, it is possible for the two sheet-metal halves of the stop 25 to be prevented from spreading apart during the pressing process.

To supplement the disclosure, reference is explicitly made to the diagrammatic illustration of the invention in FIGS. 1 to 9.

LIST OF REFERENCE SYMBOLS

1 Turbocharger
2 Turbine housing
3 Compressor housing
4 Turbine rotor
5 Adjusting ring
6 Blade bearing ring
7 Guide blades
8 Blade shaft
9 Supply duct
10 Axial connecting piece
11 Actuating device
12 Control housing
13 Free space for guide blades 7
14 Plunger element
15 Annular part of the turbine housing 2
16 Spacer/spacer cam
17 Compressor rotor
18 Guide grate/guide apparatus
19 Bearing housing
20 Blade lever
21 Fastening ring
22 Recess
23 Lever head
24 Engagement recesses
25 Stop
26 Adjusting section
27, 27' Radially projecting adjusting flanks
28, 28' Radially projecting adjusting flanks
29, 30 Stop cam
31 Groove
32 Fixing peg
33, 33' Arched central part
34 Fit bore
35 Transition section
36, 38 Lengthening webs
37, 39 Retaining fingers
40, 41 Clamps
L Longitudinal central line
H Height

The invention claimed is:

1. A turbocharger (1) with variable turbine geometry (VTG),
having a turbine housing (2) with a supply duct (9) for exhaust gases;
having a turbine rotor (4) which is rotatably mounted in the turbine housing (2); and
having a guide grate (18)
which surrounds the turbine rotor (4) radially at the outside,
which has a blade bearing ring (6),
which has a multiplicity of guide blades (7) which have in each ease one blade shaft (8) mounted in the blade bearing ring (6),
which has an adjusting ring (5) which is operatively connected to the guide blades (7) via associated blade levers (20) fastened at one of their ends to the blade shafts (8), each blade lever (20) having at the other end a lever head (23) which can be placed in engagement with an associated engagement recess (24) of the adjusting ring (5), and
which has a stop (25) at least for adjusting the minimum throughflow through the nozzle cross sections formed by the guide blades (7), wherein
the stop (25) has a fixing peg (32) on which a deformable, arched adjusting section (26) is arranged.

2. The turbocharger as claimed in claim 1, wherein the adjusting section (26) has an arched central part (33), on which adjusting flanks (27, 28) are arranged which project radially at both sides.

3. The turbocharger as claimed in claim 2, wherein the fixing peg (32) has a fit recess (34) running over its entire length (L).

4. The turbocharger as claimed in claim 2, wherein the adjusting section (26) has central parts (33, 33'), arranged opposite one another in pairs, with associated adjusting flanks (27, 28 and 27', 28').

5. The turbocharger as claimed in claim 4, wherein a transition section (35) is provided between the fixing peg (32) and the adjusting section (26).

6. The turbocharger as claimed in claim 4, wherein the adjusting section (26) is provided with clamps (40, 41) on one (33) of its central parts (33, 33').

7. The turbocharger as claimed in claim 6, wherein the clamps (40, 41) have elongation webs (36, 38) which extend from the adjusting flanks (27, 28) of one central part (33) to the other central part (33') and which, on the free ends thereof, are provided with angled retaining fingers (37, 39).

8. The turbocharger as claimed in claim 1, wherein the stop (25) is produced from sheet metal.

9. The turbocharger as claimed in claim 8, wherein the stop (25) is folded from sheet metal.

10. A guide grate (18) for a turbocharger (1) with variable turbine geometry (VTG), which guide grate (18) surrounds a turbine rotor (4) of the turbocharger (1) radially at the outside and has the following parts:
a blade bearing ring (6),
a multiplicity of guide blades (7) which have in each case one blade shaft (8) mounted in the blade bearing ring (6),
an adjusting ring (5) which is operatively connected to the guide blades (7) via associated blade levers (20) fastened at one of their ends to the blade shafts (8), each blade lever (20) having at the other end a lever head (23) which can be placed in engagement with an associated engagement recess (24) of the adjusting ring (5), and
a stop (25) at least for adjusting the minimum throughflow through the nozzle cross sections formed by the guide blades (7), wherein
the stop (25) has a fixing peg (32) on which a deformable, arched adjusting section (26) is arranged.

11. The guide grate for a turbocharger as claimed in claim 10, wherein the adjusting section (26) has an arched central part (33), on which adjusting flanks (27, 28) are arranged which project radially at both sides.

12. The guide grate for a turbocharger as claimed in claim 11, wherein the fixing peg (32) has a fit recess (34) running over its entire length (L).

13. The guide grate for a turbocharger as claimed in claim 11, wherein the adjusting section (26) has central parts (33, 33'), arranged opposite one another in pairs, with associated adjusting flanks (27, 28 and 27', 28').

14. The guide grate for a turbocharger as claimed in claim 13, wherein a transition section (35) is provided between the fixing peg (32) and the adjusting section (26).

15. The guide grate for a turbocharger as claimed in claim 10, wherein the adjusting section (26) has an arched central part (33), on which adjusting flanks (27, 28) are arranged which project radially at both sides.

16. The guide grate for a turbocharger as claimed in claim 15, wherein the fixing peg (32) has a fit recess (34) running over its entire length (L).

17. The guide grate for a turbocharger as claimed in claim 15, wherein the adjusting section (26) has central parts (33, 33'), arranged opposite one another in pairs, with associated adjusting flanks (27, 28 and 27', 28').

18. The guide grate for a turbocharger as claimed in claim 17, wherein a transition section (35) is provided between the fixing peg (32) and the adjusting section (26).

19. A stop (25) of a guide grate (18) for a turbocharger (1) with variable turbine geometry (VTG), which guide grate (18) surrounds a turbine rotor (4) of the turbocharger (1) radially at the outside and has the following parts:

a blade bearing ring (6), a multiplicity of guide blades (7) which have in each case one blade shaft (8) mounted in the blade bearing ring (6), an adjusting ring (5) which is operatively connected to the guide blades (7) via associated blade levers (20) fastened at one of their ends to the blade shafts (8), each blade lever (20) having at the other end a lever head (23) which can be placed in engagement with an associated engagement recess (24) of the adjusting ring (5), wherein the stop (25) has a fixing peg (32) on which a deformable, arched adjusting section (26) is arranged.

* * * * *